United States Patent [19]

Bruening

[11] 4,126,243

[45] Nov. 21, 1978

[54] TANK FLOATING ROOF SEAL

[75] Inventor: Robert A. Bruening, Naperville, Ill.

[73] Assignee: Chicago Bridge & Iron Company, Oak Brook, Ill.

[21] Appl. No.: 840,548

[22] Filed: Oct. 11, 1977

[51] Int. Cl.[2] ..... B65D 87/20

[52] U.S. Cl. ..... 220/224; 220/226; 220/DIG. 11

[58] Field of Search ..... 220/216, 217, 220, 222, 220/224, 226, DIG. 11; 277/230

[56] References Cited

U.S. PATENT DOCUMENTS

| | | | |
|---|---|---|---|
| 2,092,877 | 9/1937 | Haupt et al. | 220/222 |
| 2,459,178 | 1/1949 | Moyer | 220/224 |
| 2,568,728 | 9/1951 | Goldsby et al. | 220/224 |
| 3,106,310 | 10/1963 | Scherer | 220/222 |
| 3,271,039 | 9/1966 | Kohl et al. | 277/230 |
| 3,373,891 | 3/1968 | Kidd | 220/222 |
| 3,511,406 | 5/1970 | Creith et al. | 220/222 |
| 3,926,332 | 12/1975 | Okamoto | 220/226 |

FOREIGN PATENT DOCUMENTS

| | | | |
|---|---|---|---|
| 929,723 | 6/1963 | United Kingdom | 220/226 |

*Primary Examiner*—William Price
*Assistant Examiner*—Joseph Man-Fu Moy
*Attorney, Agent, or Firm*—Merriam, Marshall & Bicknell

[57] ABSTRACT

The improvement in a liquid storage tank having a floating roof, a plurality of shoes adapted to slidably contact the inner side wall of the tank, and means supported by the roof for pressing the shoes against the inner side wall, comprising an elastomeric body composite strip, impermeable to vapor, in the form of an annulus connected at its bottom edge portion by an essentially vapor tight joint to the top circumference of the shoes and its top edge portion in movable sealing contact with the tank inner side wall, said strip in radial vertical cross section being convexly arced when viewed from the roof, and the strip comprising a plurality of flexible resilient elongated stiffeners laterally positioned and embedded in the body of elastomeric material and extending from the bottom of the strip joined to the shoes to ends which terminate substantially short of the top edge of the strip thereby providing a strip having an upper portion more flexible and less stiff than the remainder of the strip body and which can flex 180° during vertical displacement of the shoes in the tank.

4 Claims, 2 Drawing Figures

TANK FLOATING ROOF SEAL

Figure 1:
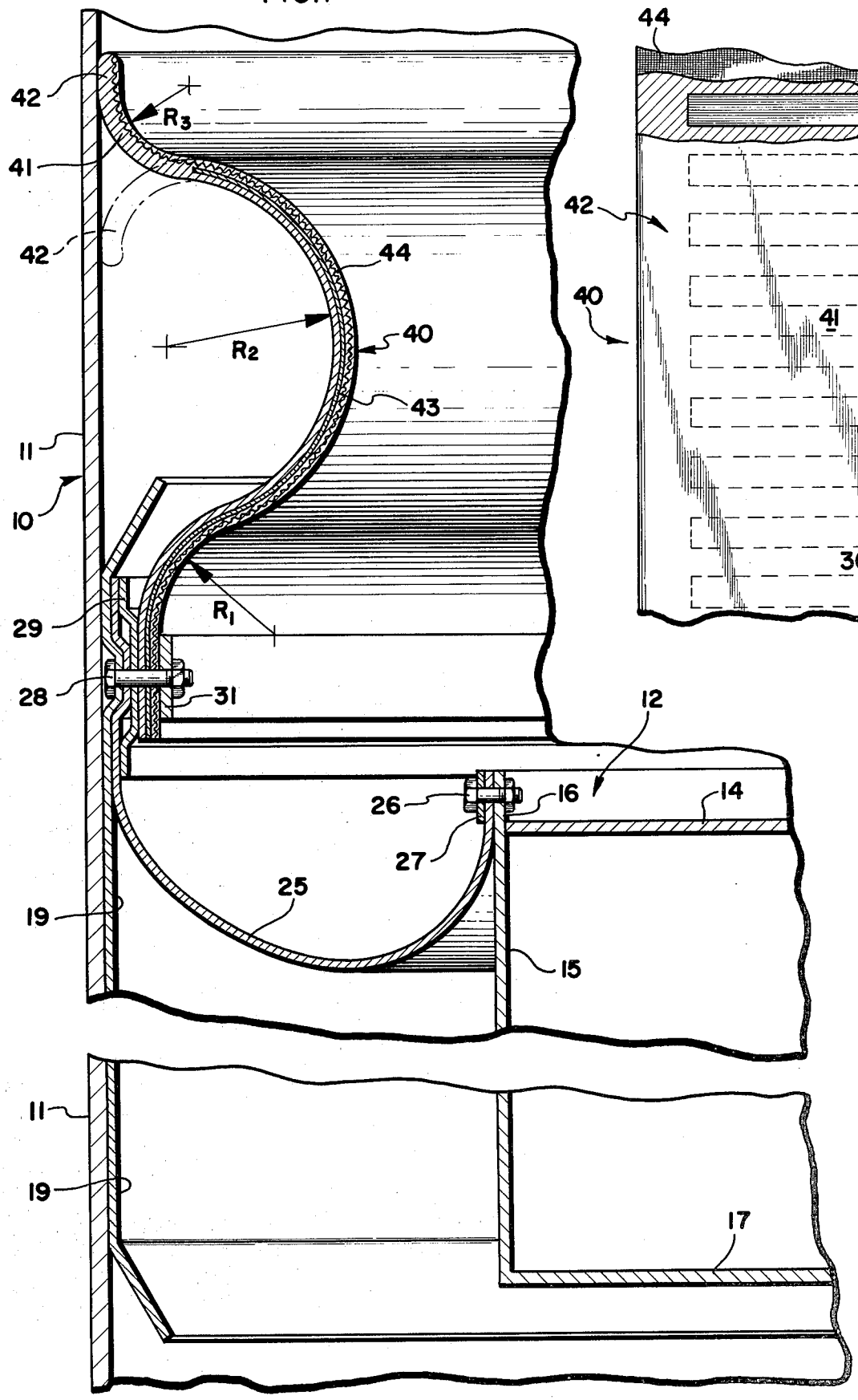

This invention relates to an improvement in floating roof tanks used for the storage of petroleum products or other volatile liquid materials, and in particular relates to an improved seal for a floating roof.

In a conventional floating roof tank, there is provided a clearance space or rim space between the tank side wall and the vertical rim of the roof. This space is necessary to provide clearance to permit unrestrained vertical travel of the roof within the tank. The clearance space is of sufficient size that local dimensional variations in the circularity and straightness of the tank sidewall or shell, which can result from uneven foundation settlement, imprecise fabrication or erection or unusual live loads such as high winds and the like, do not hamper vertical travel of the roof.

To maintain the roof centered in the tank and to effect a seal against evaporation loss, it is conventional to use a plurality of vertical shoes adapted to slidably contact the entire circular inner side wall of the tank and means supported by the roof for pressing the shoes against the inner side wall, as well as to support the shoes. Vapor loss through the clearance space is prevented by a flexible nonpermeable fabric barrier which extends from the upper part of the shoes to the floating roof top edge. Such structures are disclosed in many United States patents including U.S. Pat. Nos. 2,587,508; 2,611,504; 2,630,937; 2,649,985 and 2,696,930.

The described primary seal system has been proven over many years use to be highly effective. However, the increasingly more stringent environmental protection rules make it desirable to provide a secondary seal system so as to further prevent, or minimize, vapor escape from between the shoes and the inner side wall of the tank. This is especially desirable when considering tank shells of riveted construction and the associated protrusions caused by laps and rivet heads at the joints.

According to the present invention, there is provided an improved liquid storage tank having a floating roof, a plurality of shoes adapted to slidably contact the inner side wall of the tank, and means supported by the roof for pressing the shoes against the inner side wall, in which the improvement comprises an elastomeric body composite strip, impermeable to vapor, in the form of an annulus connected at its bottom edge portion by an essentially vapor tight joint to the top circumference of the shoes and its top edge portion in movable sealing contact with the tank inner side wall, said strip in radial vertical cross section being convexly arced when viewed from the roof, and in which the strip comprises a plurality of flexible resilient elongated stiffeners laterally positioned and embedded in the body of elastomeric material and extending from the bottom of the strip joined to the shoes to ends which terminate substantially short of the top edge of the strip thereby providing a strip having an upper portion more flexible and less stiff than the remainder of the strip body and which can flex 180° during vertical displacement of the shoes in the tank. The elongated stiffeners are advisably spaced apart from each adjacent stiffener, which may be made of spring metal or polymeric material. The stiffeners can be elongated rectangular fingers or the fingers may be tapered and narrower at the outer ends. Also, a fabric can be embedded in the elastomeric material for reinforcement.

Figure 2:
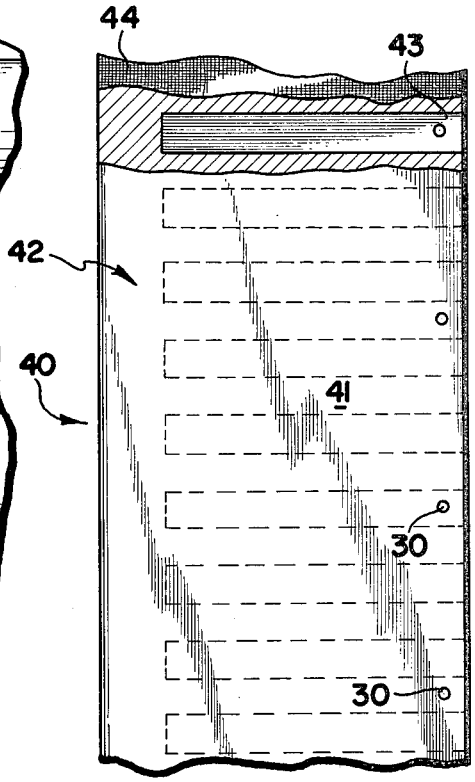

The invention will be described further in conjunction with the attached drawings, in which:

FIG. 1 is a vertical sectional view through a liquid storage tank showing portions of the side wall, the floating roof and shoes, and a secondary seal elastomeric body composite strip mounted at the top of the shoes; and FIG. 2 is a plan view partially in section of the composite strip shown in FIG. 1.

So far as is practical the same elements or parts which appear in the various figures of the drawings will be illustrated by the same numbers.

Referring to FIG. 1, liquid storage tank 10 has a side wall 11 and a floating roof 12. The floating roof 12 has a top 14, a side 15 terminating in an upper vertical rim 16 and a bottom 17. The shoes 19 are suspended in surface-to-surface contact with the tank side wall 11 by a hanger-pusher mechanism (not shown) such as a weighted pantagraph. The shoes 19 are constructed of flexible metal sheets and are provided with vertical stiffening means in the form of vertical spaced apart flexures in the form of a U-shaped corrugation (see U.S. Pat. No. 2,611,504). The roof 12 floats on liquid in the tank and rises and falls as the level of the liquid is raised or lowered, during which movement the shoes contact the side wall of the tank.

Flexible sheet material vapor barrier 25 is connected at its inner edge by bolts 26 and metal band 27 to roof edge 16. The upper or outer edge of vapor barrier 25 is connected to the upper portion of shoes 19 by means of bolts 28 and metal band 29. The bolts 28 furthermore extend through holes 30 (FIG. 2) of strip 40 and through holes in metal band 31 to thereby securely join the lower or bottom edge of the strip to the shoes 19.

The strip 40 comprises an elastomeric body 41, impermeable to vapor, in the form of an annulus. The strip in radial vertical cross section is convexly arced when viewed from the roof. The top edge portion 42 is in movable sealing contact with the tank inner side wall.

The strip 40 as shown in the drawings has a plurality of spaced apart flexible resilient elongated stiffeners 43 laterally positioned and embedded in the elastomeric body 41, which may be made of a synthetic rubber such as neoprene. The stiffeners extend from the strip bottom edge portion joined to the shoes and terminate substantially short of or below the top edge of the strip thereby providing a strip having an upper portion more flexible and less stiffened than the remainder of the strip body and which can flex 180° during vertical displacement of the shoes in the tank as shown in FIG. 1 where the end 42 can assume flip-flop positions and still maintain an excellent seal against the tank wall.

The stiffeners 43 may be flat rectangular fingers or the fingers can be tapered with the narrower end at the top. Wires or tubes can also be used as the stiffeners. The stiffeners, furthermore, can be made of metal such as spring steel or spring aluminum, or of a solid polymeric material such as nylon, polypropylene, or polymethacrylate with glass fibers embedded therein. To reinforce the elastomeric body a fabric layer 44 can be included and it can extend for essentially the full length and width of the strip.

Strip 40 can be manufactured in the desired arced shape or it can be made flat and then bent to shape if the material used for the stiffeners can withstand such forming without failing. The strip 40 as shown in FIG. 1 can have a $R_1$ radius of about 1.4 in., an $R_2$ radius of about 2 in. and an $R_3$ radius of about 1 in. and the elastomeric body can be neoprene rubber 0.375 in. thick and the strip width can be 10.5 in. The stiffeners can be 1 in. wide, 1 in. apart and 9 in. long.

The foregoing detailed description has been given for clearness of understanding only, and no unnecessary limitations should be understood therefrom as modifications will be obvious to those skilled in the art.

What is claimed is:

1. In a liquid storage tank having a floating roof, a plurality of shoes adapted to slidably contact the inner side wall of the tank, and means supported by the roof for pressing the shoes against the inner side wall, the improvement comprising:

an elastomeric body composite strip, impermeable to vapor, in the form of an annulus connected at its bottom edge portion by an essentially vapor tight joint to the top circumference of the shoes and its top edge portion in movable sealing contact with the tank inner side wall, said strip in radial vertical cross section being convexly arced when viewed from the roof, and the strip comprising a plurality of flexible resilient elongated stiffeners laterally positioned and embedded in the body of elastomeric material and extending from the bottom of the strip joined to the shoes to ends which terminate substantially short of the top edge of the strip thereby providing a strip having an upper portion more flexible and less stiff than the remainder of the strip body and which can flex 180° during vertical displacement of the shoes in the tank.

2. The improvement according to claim 1 in which the elongated stiffeners are flat fingers.

3. The improvement according to claim 2 in which the fingers are made of polymeric material or spring metal.

4. The improvement according to claim 1 in which a fabric is embedded in the strip to reinforce the elastomeric body.

* * * * *